United States Patent [19]

Knapp

[11] 4,073,504

[45] Feb. 14, 1978

[54] AMUSEMENT DEVICE

[76] Inventor: Catherine Knapp, 15010 Hamlin, Midlothian, Ill. 60445

[21] Appl. No.: 656,356

[22] Filed: Feb. 9, 1976

[51] Int. Cl.[2] ..... B62B 11/00

[52] U.S. Cl. ..... 280/220; 272/1 R; 280/205

[58] Field of Search ..... 280/220, 221, 205, 87.04 R, 280/47.3, 606; 272/1 R, 1 B, 1 E, 114, 61, 69; 114/235 WS; 115/2, 6.1; 301/1 R, 5 R

[56] References Cited

U.S. PATENT DOCUMENTS

| | | | |
|---|---|---|---|
| 1,594,479 | 8/1926 | Swofford | 272/1 R |
| 2,186,606 | 1/1940 | Hutchinson | 272/1 E |
| 2,268,827 | 1/1942 | Jackson | 272/1 E X |
| 2,819,907 | 1/1958 | Thoresen | 280/606 X |
| 2,829,891 | 4/1958 | Ludwig | 272/1 R |
| 2,938,727 | 5/1960 | Nosak | 272/1 B X |
| 3,106,395 | 10/1963 | Birkenbeul | 272/1 E |
| 3,110,047 | 11/1963 | Bringman | 272/1 B X |
| 3,298,223 | 1/1967 | Dyer | 301/5 R X |
| 3,628,491 | 12/1971 | Conrad | 272/1 B |
| 3,677,571 | 7/1972 | Maturo | 280/47.3 |

FOREIGN PATENT DOCUMENTS

| | | | |
|---|---|---|---|
| 364,505 | 11/1922 | Germany | 272/1 E |

*Primary Examiner*—Joseph F. Peters, Jr.
*Assistant Examiner*—Terrance L. Siemens
*Attorney, Agent, or Firm*—Robert D. Farkas

[57] ABSTRACT

An amusement device having means for treading thereon which causes a rolling action. The device includes a pair of straps for the stabilization of the user.

8 Claims, 3 Drawing Figures

AMUSEMENT DEVICE

BACKGROUND OF THE INVENTION

This invention relates to an amusement device, and more particularly to a device which may be used for treading thereon.

Treading on the device causes a rolling action. The maintainence of balance while treading on the device as it is rolling is a skill that can be developed with practice by the user. The use of the device also challenges the users agility and coordination.

The primary object of the present invention is to provide a device for treading thereon to be used by children for exercise.

Another object of the present invention is to provide a device for treading thereon as an amusement.

It is a further object of the present invention to provide a device for treading thereon which will help develop a child's balance, agility, and coordination.

The present invention thus provides a simple, fascinating toy. These objects, as well as other objects, of the present invention will become readily apparent after reading the description of the accompanying drawings.

SUMMARY OF THE INVENTION

An amusement device according to the present invention comprises, a cylindrical member for treading thereon, an axle that journals with bearings in the cylindrical member, and a pair of flexible straps fixed on opposing ends of the axle for the stabilization of the user.

BRIEF DESCRIPTION OF THE DRAWINGS

In order that the present invention may be more fully understood, it will now be described, by way of example, with reference to the accompanying drawings in which.

DESCRIPTION OF THE PREFERRED EMBODIMENT

Figure 1:
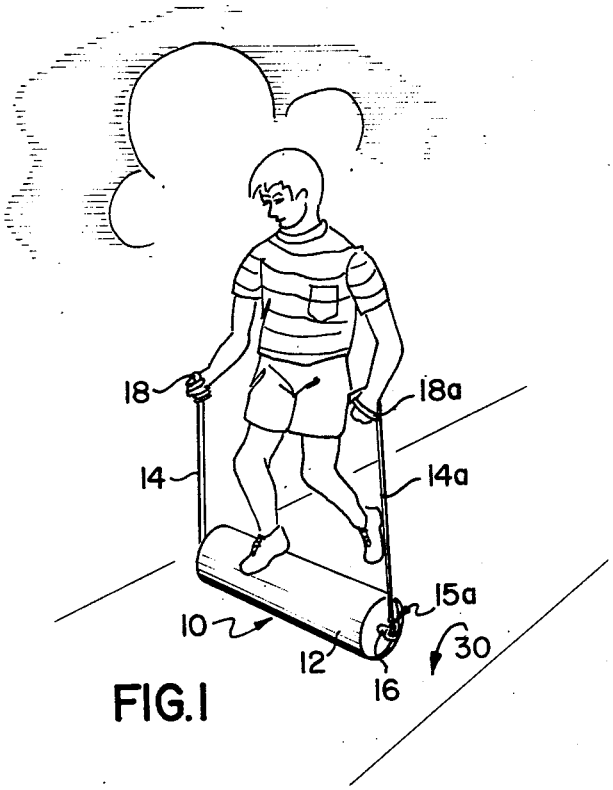
FIG. 1 is a pictorial view of the preferred embodiment of the present invention showing the same in use.

Referring now to the Figures and more particularly, to the embodiment illustrated in FIG. 1, showing the amusement device 10 in use. The user is treading on a cylindrical member 12. A pair of flexible straps 14, 14*a* are affixed by a means, 15*a* to an axle 16 on one end and to a pair of handles 18, 18*a* on the opposing end held by the user. The cylindrical member 12 can be treaded forward or backward and is preferably constructed of a rigid, smooth surfaced material such as plastic or wood. Amusement device 10 is for use preferably by children under 14 years old and preferably is in black for boys and multi-colors for girls.

Figure 2:
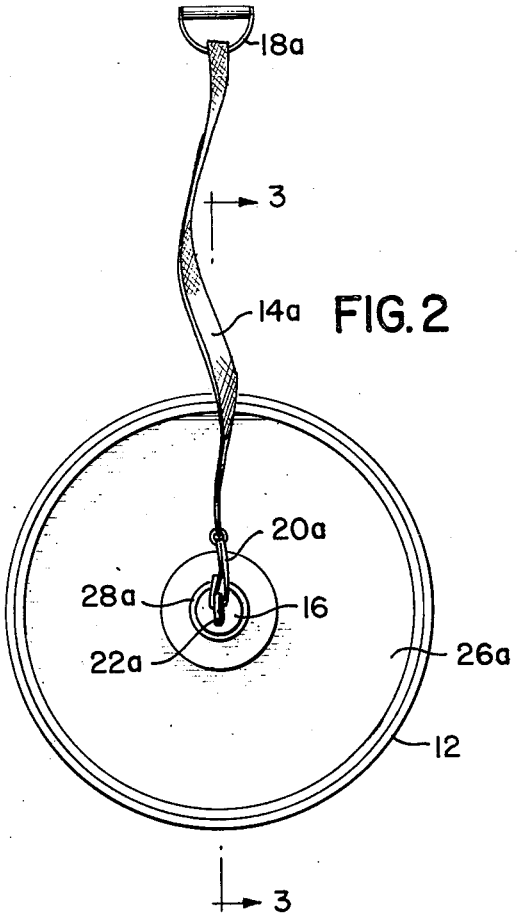
FIG. 2 is an end view of the preferred embodiment of the present invention supported on solid material or the ground.
Figure 3:
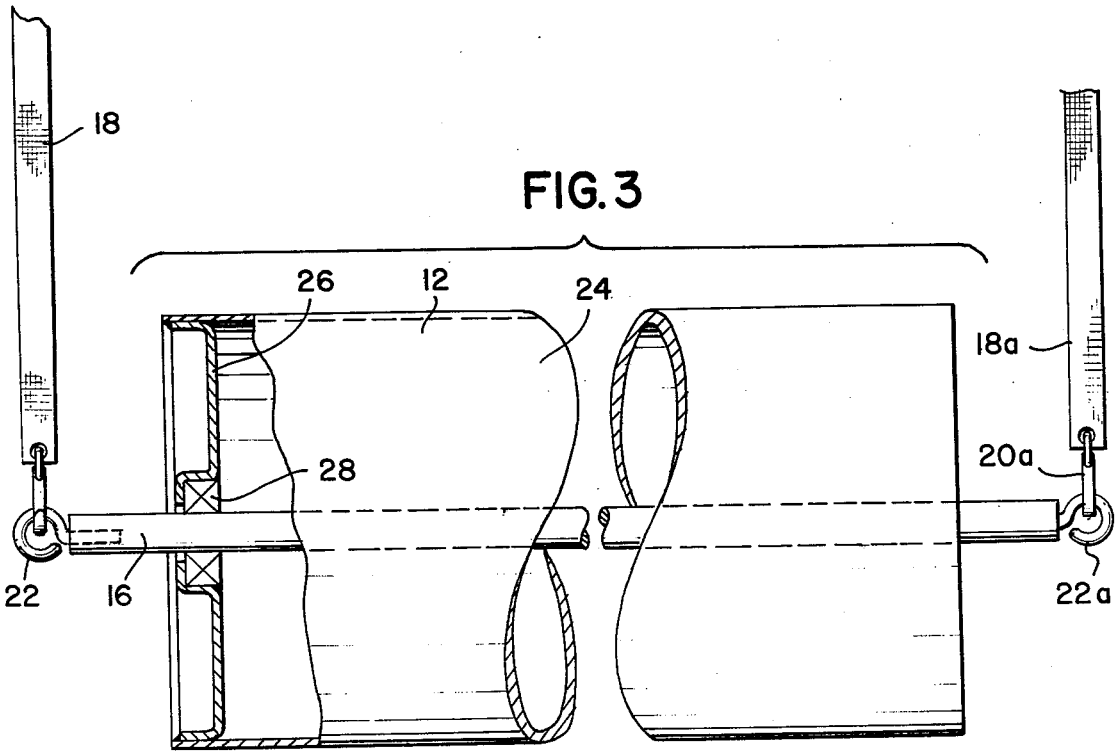
FIG. 3 is a front view, partially broken away substantially along line 3 — 3.

FIG. 2 and FIG. 3 illustrate an end view and a front view respectively of the preferred embodiment of the present invention showing the handle 18*a* affixed to the strap 14*a* which is secured to a snap hook 20*a*. The snap hook 20*a* is demountably attached to an eye 22*a* secured in the axle 16. The axle 16 is inserted through the cylindrical member 12 comprising a cylinder 24 with a pair of caps 26, 26*a* affixed on each end, and a pair of journals 28, 28*a* affixed to the caps 26, 26*a*. The axle 16 journals with the pair of bearings 28, 28*a* when the device 10 is being treaded. Bearings 28, 28*a* are preferably of the anti-friction type and may be roller bearings or ball bearings. The width of cylindrical member 12 is preferably greater in measurement than its diameter.

The operation of the preferred embodiment of the present invention is very simple. The amusement device 10 is placed on the ground or suitable support 30. Treading upon the device 10 by the user causes a backward or forward rolling motion. During this motion with the use of the flexible straps 14, 14*a* the user tries to maintain balance as not to fall off cylindrical member 12.

It will be understood that various changes in the details, materials, arrangements of parts and operating conditions which have been herein described and illustrated in order to explain the nature of the invention may be made by those skilled in the art within the principles and scope of the invention.

What is claimed is:

1. An amusement device for treading thereon, comprising:

a. a cylindrical member comprising a hollow cylinder with a pair of end caps each supporting a bearing, b. an axle that journals within said cylindrical member and c. a pair of flexible stabilization straps attached at opposite ends of said axle.

2. An amusement device according to claim 1, wherein said cylindrical member comprises a rigid smooth surfaced material.

3. An amusement device according to claim 1, wherein said flexible stabilization straps are separable from said axle.

4. An amusement device according to claim 1, wherein handles are attached to said flexible stabilization straps.

5. An amusement device according to claim 1, wherein the width of said cylindrical member is greater in measurement to its diameter.

6. An amusement device according to claim 1, wherein said bearings are an anti-friction type.

7. An amusement device according to claim 6, wherein said anti-friction bearings are of the roller type.

8. An amusement device according to claim 6, wherein said anti-friction bearings are of the ball type.

* * * * *